US006068157A

United States Patent [19]

Kamiya

[11] Patent Number: 6,068,157

[45] Date of Patent: May 30, 2000

[54] STACKED-PAPER DISPENSER

[75] Inventor: Takahisa Kamiya, Shizuoka-ken, Japan

[73] Assignee: Super Planning Co., Ltd., Shizuoka-ken, Japan

[21] Appl. No.: 09/047,515

[22] Filed: Mar. 25, 1998

[30] Foreign Application Priority Data

Mar. 25, 1997 [JP] Japan ..... 9-071671

[51] Int. Cl.[7] ..... B65H 3/00

[52] U.S. Cl. ..... 221/36; 221/259; 221/62; 271/19

[58] Field of Search ..... 221/31, 41, 42, 221/43, 62, 231, 232, 259, 261; 271/19, 22, 24, 25; 206/39.4

[56] References Cited

U.S. PATENT DOCUMENTS

| | | | |
|---|---|---|---|
| 538,152 | 4/1895 | Bussman | 221/259 |
| 1,527,737 | 2/1925 | LaLonde et al. | 221/259 |
| 1,886,694 | 11/1932 | Kelly | 221/41 |
| 2,290,086 | 7/1942 | Trollen | 221/41 |
| 4,941,591 | 7/1990 | Lin et al. | 221/259 |

FOREIGN PATENT DOCUMENTS

| | | | |
|---|---|---|---|
| 978387 | 4/1951 | France | 221/259 |
| 238637 | 9/1911 | Germany | 221/259 |
| 649783 | 9/1937 | Germany | 271/19 |
| 2210603 | 6/1989 | United Kingdom . | |

*Primary Examiner*—H. Grant Skaggs
*Attorney, Agent, or Firm*—Lowe Hauptman Gopstein Gilman & Berner

[57] ABSTRACT

A stacked-paper dispenser in which a stack of paper is accommodated for dispensing a piece of paper is provided with: an accommodating member for accommodating the stack of paper therein; a stacked-paper placing base on which the stack of paper is placed, the stacked paper placing base being fitted in the accommodating member and adapted to be resiliently raised upward; a cover having an opening portion for dispensing the piece of paper; and a paper dispensing device including a bearing member capable of reciprocating in a longitudinal direction on an inner surface side of the cover, a roller member which is axially supported by the bearing member and which is nonrotatable in the movement in an advancing direction of the bearing member and rotatable in a returning direction, and a thumb slider for operating the bearing member from outside the cover.

8 Claims, 9 Drawing Sheets

STACKED-PAPER DISPENSER

BACKGROUND OF THE INVENTION

1. Field of the Invention

The present invention relates to a stacked-paper dispenser in which stacked sheets of paper, such as adhesive tags or an adhesive memo pad, are accommodated, and which is capable of dispensing one sheet at a time among the stacked pieces of paper when necessary, and of particularly allowing even up to the substantially last sheet to be dispensed among a small number of remaining stacked sheets of paper.

2. Description of the Related Art

In recent years, stacks of paper in which partly pasted pieces of paper are bundled together for the purpose of writing a memo or attaching the partly pasted piece of paper on a particular page of a book, a notebook, or the like have come to be used extensively. There have been practically no suitable handy tools in which a stack of paper, including such paper and tags, is accommodated and which have a mechanism capable of easily dispensing a sheet at a time among the stacked pieces of paper when necessary.

For this reason, the above-described stack of paper is left as it is in an exposed state, or is carried as it is. Hence, the stack of paper is liable to become soiled, or the bundle of the stack of paper often becomes disintegrated, causing the pieces of paper to be separated into pieces. Thus, the handling and storage of the above-described stack of paper has been very inconvenient.

For this reason, a number of accommodating cases are available in which the stack of paper is accommodated and which are aimed to be carried to any place. Among such accommodating cases of this type, there is no convenient accommodating case having the mechanism capable of reliably and easily dispensing a sheet at a time among the stacked pieces of paper when necessary.

Further, when only a small number of pieces of stacked paper accommodated are left, even if an attempt is made to take out one sheet of paper, the bundle in its entirety tends to be drawn out due to the adhesive portion, so that the stack of paper whose number of sheets has decreased is often discarded, and is wasted. From such a standpoint as well, such an accommodating case has been very inconvenient in use.

SUMMARY OF THE INVENTION

In view of the above-described circumstances, it is an object of the present invention to provide a stacked-paper dispenser which is capable of dispensing a sheet of paper at a time among stacked pieces of paper when necessary, and allowing even up to the substantially last sheet to be dispensed reliably among a small number of remaining stacked sheets of paper, thereby overcoming the above-described drawbacks of the conventional art.

To this end, in accordance with a first aspect of the present invention, there is provided a stacked-paper dispenser in which a stack of paper is accommodated for dispensing a piece of paper comprising: an accommodating member for accommodating the stack of paper therein; a stacked-paper placing base on which the stack of paper is placed, the stacked paper placing base being fitted in the accommodating member and adapted to be resiliently raised upward; a cover having an opening portion for dispensing the piece of paper; and a paper dispensing device including a bearing member capable of reciprocating in a longitudinal direction on an inner surface side of the cover, a roller member which is axially supported by the bearing member and which is nonrotatable in the movement in an advancing direction of the bearing member and rotatable in a returning direction, and a thumb slider for operating the bearing member from outside the cover.

In accordance with this aspect of the present invention, the operation of dispensing the uppermost piece of stacked paper accommodated in the accommodating member can be effected reliably, and the structure can be made very simple.

Since the paper dispensing device has the roller member which is fitted to the bearing member and which is nonrotatable in the movement in the advancing direction of the bearing member and rotatable in the returning directions the roller member moves in the nonrotatable state in the advancing direction with respect to the uppermost piece of paper of the accommodated stack of paper. Hence, friction occurs between the roller member and the uppermost piece of paper, and as the roller member drags the uppermost piece of paper, the roller member is able to cause the uppermost piece of paper to be lifted off the remaining sheets of stacked paper. Thus, the piece of paper can be caused to project from the opening portion with such a very simple structure.

On the other hand, since the roller member 10 is rotatable in the returning direction, practically no friction occurs in the returning motion between the uppermost piece of stacked paper and the roller member, so that the roller member can be returned to its original position without dragging the ensuing piece of paper.

In accordance with a second aspect of the present invention, in the stacked-paper dispenser according to the first aspect of the invention, an outer periphery of the roller member has a multiplicity of small projections.

In accordance with a third aspect of the present invention, there is provided a stacked-paper dispenser in which a stack of paper is accommodated for dispensing a piece of paper, comprising: an accommodating member for accommodating the stack of paper therein; a stacked-paper placing base on which the stack of paper is placed, the stacked paper placing base being fitted in the accommodating member and adapted to be resiliently raised upward; a cover having an opening portion for dispensing the piece of paper, the cover having a protruded portion which is located adjacent to the opening portion and is formed over an entire widthwise range of the cover in such a manner as to protrude upwardly; and a paper dispensing device including a bearing member capable of reciprocating in a longitudinal direction on an inner surface side of the protruded portion, a roller member which is axially supported by the bearing member and which is nonrotatable in the movement in an advancing direction of the bearing member and rotatable in a returning direction, a stacked-paper pressing rod provided in a reciprocating range of the roller member and in proximity to a side of the roller member which is closer to the stacked-paper placing base, and a thumb slider for operating the bearing member from outside the cover.

In accordance with a fourth aspect of the present invention, in the stacked-paper dispenser according to the third aspect of the invention, the stacked-paper pressing rod has its longitudinal opposite ends fixed to longitudinal opposite side portions in an interior of the protruded portion.

In accordance with a fifth aspect of the present invention, in the stacked-paper dispenser according to the third aspect of the invention, the stacked-paper pressing rod has one longitudinal end fixed to a longitudinal rear end portion of an inner surface of the protruded portion, and another longitudinal end set free, such that the stacked-paper pressing rod is constantly set in a state of resiliently pressing the stack of paper toward the stacked-paper placing base.

The above and other objects, features and advantages of the present invention will become more apparent from the following detailed description of the invention when read in conjunction with the accompanying drawings.

DESCRIPTION OF THE PREFERRED EMBODIMENTS

Figure 1A:
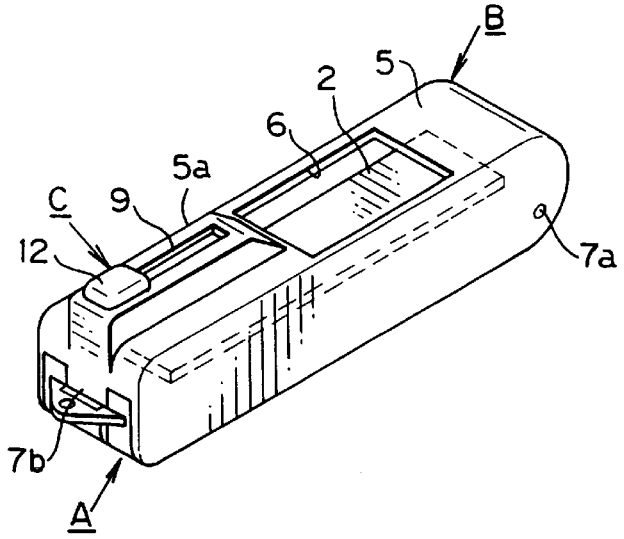
FIG. 1A is a perspective view illustrating a state in which a cover is closed with respect to an accommodating member of a stacked-paper dispenser in accordance with a first embodiment of the present invention.
Figure 1B:
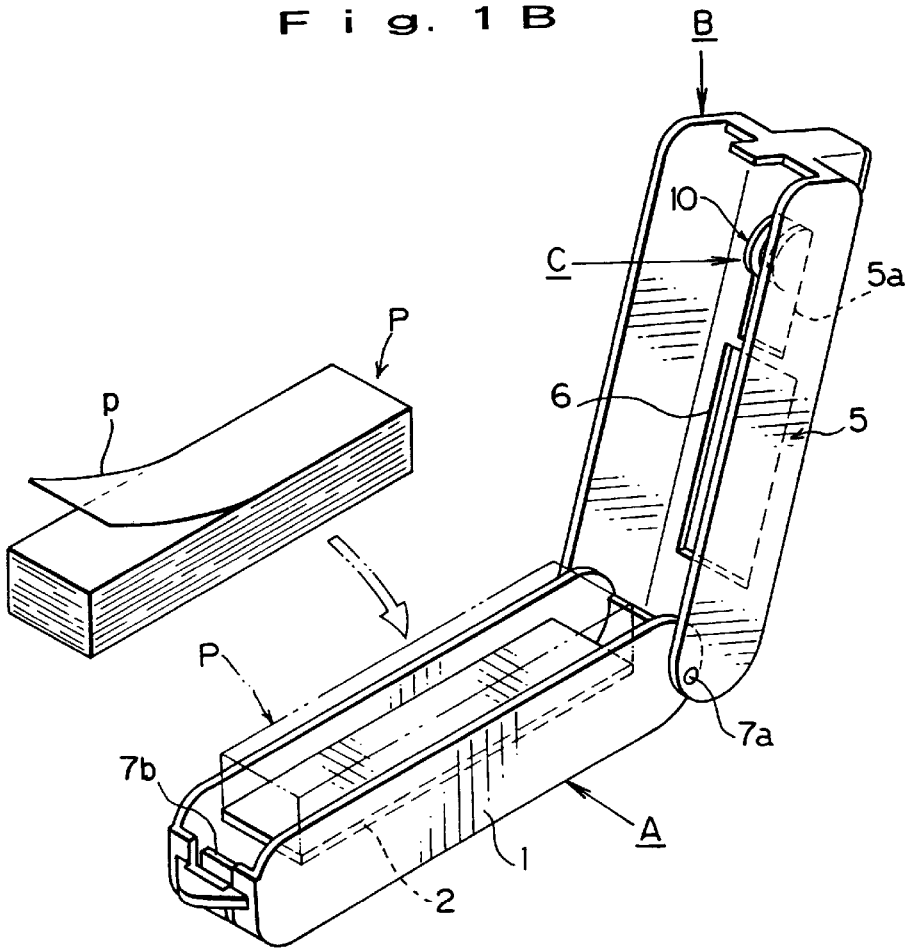
FIG. 1B is a perspective view illustrating a state in which the cover is opened with respect to the accommodating member, and a stack of paper is to be loaded inside the accommodating member.
Figure 1C:
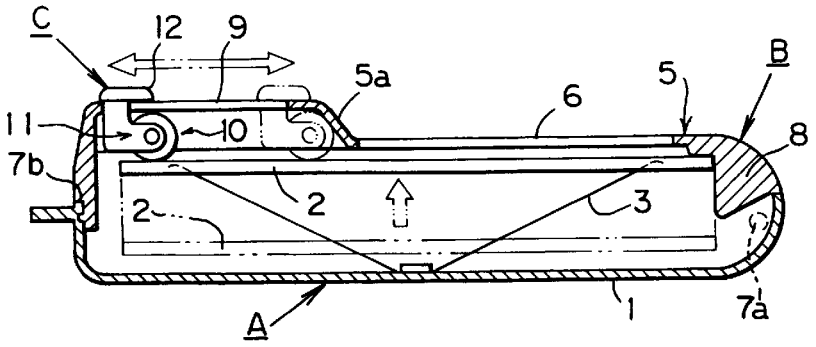
FIG. 1C is a longitudinal cross-sectional view of the stacked-paper dispenser.

Referring now to the accompanying drawings, a description will be given of the embodiments of the present invention. As shown in FIGS. 1A to 1C, the stacked-paper dispenser in accordance with a first embodiment of the present invention is mainly comprised of an accommodating member A, a cover B in which an opening portion 6 for taking out a piece of paper p is formed, and a paper dispensing device C which is fitted to the cover B.

The accommodating member A is arranged such that a stacked-paper placing base 2 having a mechanism whereby the stacked-paper placing base 2 is resiliently raised upward toward the cover B is fitted inside a case 1 having the shape of a substantially rectangular box with its upper portion open.

The stacked-paper placing base 2 has a resilient member 3 provided between the same and the bottom of the case 1, so that the stacked-paper placing base 2 is arranged to be constantly pushed upward by the resilient member 3. A leaf spring, a coil spring, or the like is used as the resilient member 3.

Next, the cover B is combined with the accommodating member A in such a manner as to be openable, and as the cover B is opened, a stack of paper P can be placed on the stacked-paper placing base 2 inside the accommodating member A (see FIG. 1A).

The cover B has a cover member 5 and the opening portion 6 formed in the cover member 5. The cover member 5 is slightly larger than the case 1 of the accommodating member A, and the cover member 5 is substantially fitted over the case 1 in such a manner as to surround the outer peripheries of the case 1 in a state in which the cover B is closed with respect to the accommodating member A. The opening portion in the cover member 5 is formed in a rectangular, square, or other similar shape, and has a size allowing the piece of paper p to be taken out easily.

In addition, a pair of pivotal connection portions 7*a* are formed in the accommodating member A and the cover B on one longitudinal end sides thereof to effect the opening and closing operation of the cover B with respect to the accommodating member A by using the pivotal connections as the center of rotation. Specifically, each connection 7*a* has a structure consisting of a combination of a projection and a hole (see FIG. 1B).

In addition, a pressing portion 8 is formed on the cover B in the vicinity of the connections 7*a* of the cover B. As one longitudinal end portion (adhesive side) of the stack of paper P which has been resiliently raised upward by the stacked-paper placing base 2 is pressed by the pressing portion 8, the position of the top portion of the stack of paper P is fixed, so that the state in which the stack of paper P is accommodated in the accommodating member A can be stabilized (see FIG. 1C).

A guide hole 9 for the paper dispensing device C which will be described later is formed in the cover member 5 in the longitudinal direction of the cover B. Further, a protruding portion 5*a* which is located adjacent to a longitudinal end of the guide hole 9 is formed on the cover member 5 in such a manner as to protrude upwardly from the cover member and form a recessed chamber as viewed from the inner side of the cover member 5. In addition, a lock portion 7*b* is formed on the other longitudinal ends of the accommodating member A and the cover B, which is opposite to the endportion where the pivotal connections 7*a* are provided. The lock portion 7*b* maintains the cover B closed with respect to the accommodating member A.

The paper dispensing device C includes a roller member 10, a bearing member 11, and a thumb slider 12. The bearing member 11 and the roller member 10 are fitted inside the protruding portion 5*a*, such that a portion of the roller member 10 projects downward so as to constantly abut against the stack of paper P inside the accommodating member A (see FIG. 2A).

Figure 7A:
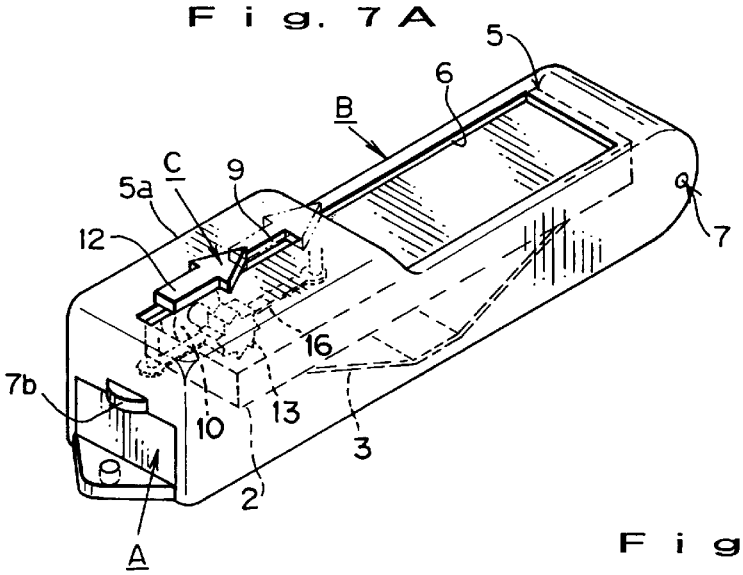
FIG. 7A is a perspective view of a stacked-paper dispenser in accordance with a second embodiment of the present invention, in which a protruded portion is formed over the entire widthwise range of the cover.

The protruding portion 5*a* may be formed in such a manner as to project only in a transversely central portion of the cover member 5 (see FIG. 1A), or may be formed over the entire widthwise range of the cover member 5 (see FIG. 7A), which will be described in the second embodiment of the present invention.

Figure 2A:
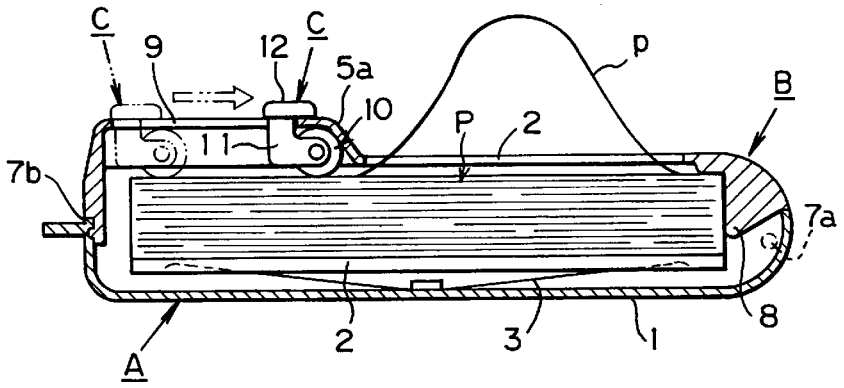
FIG. 2A is a longitudinal cross-sectional view illustrating a state in which an uppermost piece of paper is being dispensed from the stacked-paper dispenser accommodating the stack of paper.

The bearing member 11 is coupled to the thumb slider 12 on the outer side of the cover B. As the user operates the thumb slider 12 on the outer side of the cover B, the bearing member 11 and the roller member 10 inside the cover B can be reciprocated in the longitudinal direction. A coupling portion for coupling the bearing member 11 and the thumb slider 12 is passed through the guide hole 9 formed in the cover B (see FIGS. 2B and 2C).

The roller member 10 is pivotally supported by the bearing member 11 so as to be rotatable only in one direction. Specifically, the roller member 10 is nonrotatable with respect to the bearing member 11 only when the roller member 10 moves in the direction in which the roller member 10 abutting against the uppermost piece of paper p of the stack of paper P causes the uppermost piece of paper p to be separated from the other paper and to be lifted up.

Figure 2B:
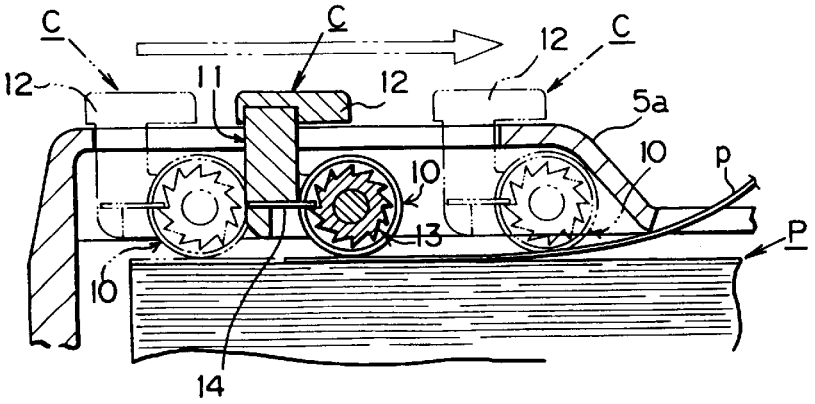
FIG. 2B is a longitudinal cross-sectional view of essential portions in which a roller member is being moved in a nonrotatable state in an advancing direction.
Figure 2C:
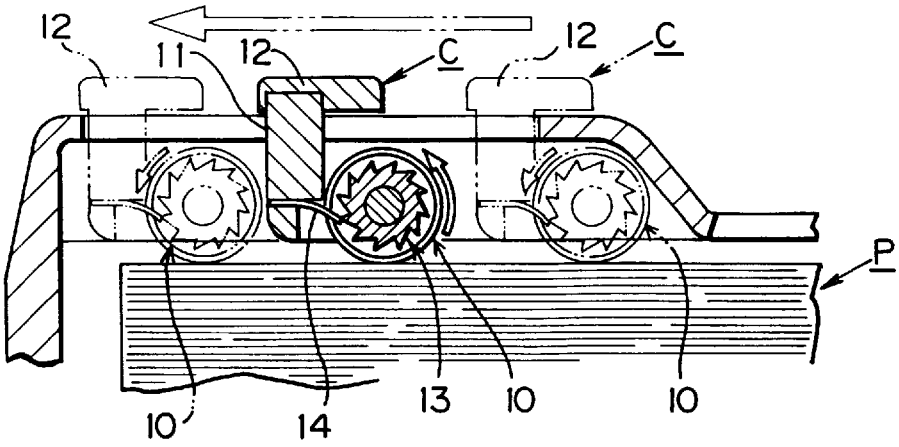
FIG. 2C is a longitudinal cross-sectional view of the essential portions in which the roller member is being moved in a rotatable state in a returning direction.

As a result, only the uppermost piece of paper p can be lifted up from the remaining stack of paper P, and that uppermost piece of paper can be made to project upward from the opening portion 6 in the cover (FIG. 2B). Then, after the piece of paper p projecting from the opening portion 6 is removed, the roller member 10 rolls over a next uppermost piece of paper p of the stack of paper P as the roller member 10 returns to its original position.

As a first example of the paper dispensing device C, a pair of axially supporting portions 11*a* are formed on the bearing member 11, and the roller member 10 and a ratchet wheel 13, which is disposed adjacent to and rotates integrally with the roller member 10, are axially supported by the axially supporting portions 11*a* (see FIGS. 3A to 3D).

Figure 3A:
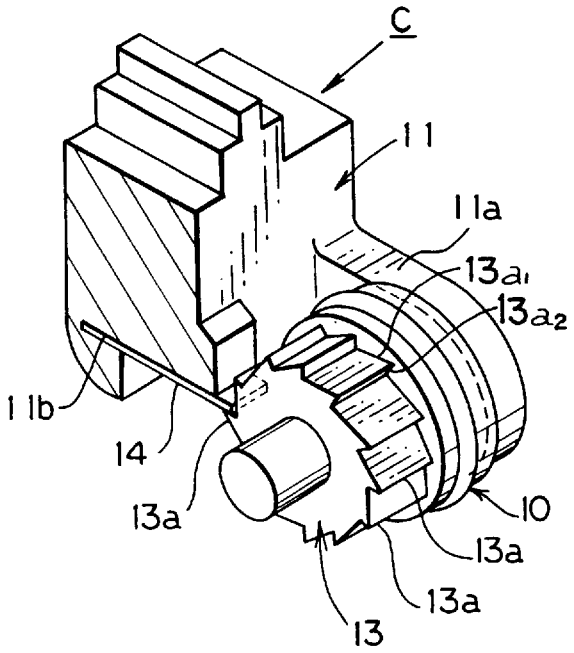
FIG. 3A is an enlarged perspective view, partly in section, of an essential portion of a first example of a paper dispensing device.
Figure 3B:
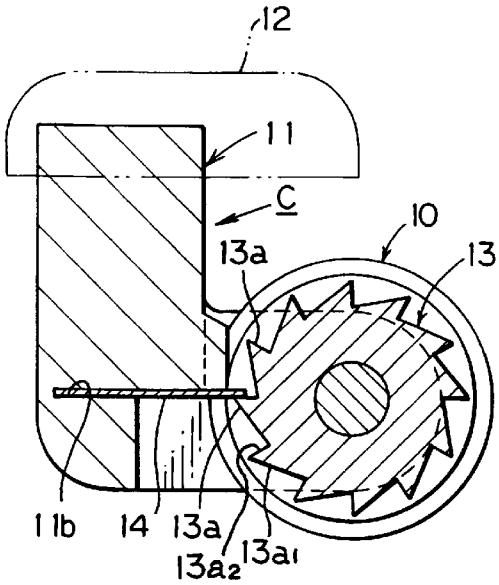
FIG. 3B is an enlarged vertical cross-sectional view of the essential portion of the paper dispensing device shown in FIG. 3A.
Figure 3C:
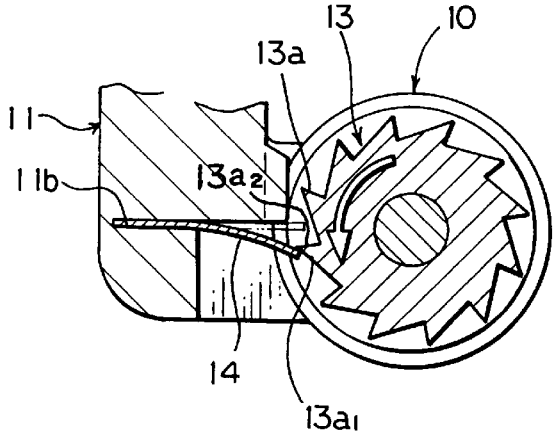
FIG. 3C is an enlarged vertical cross-sectional view of the essential portion illustrating the operation of the paper dispensing device.
Figure 3D:
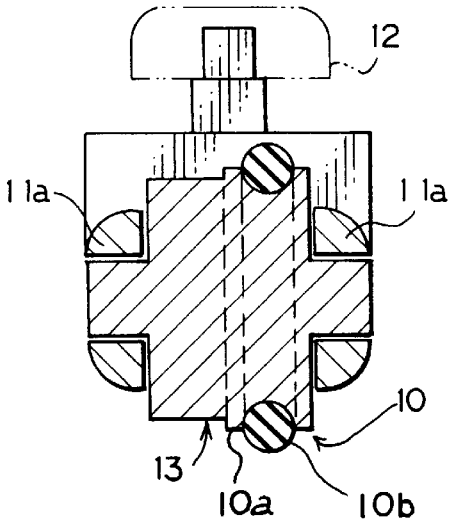
FIG. 3D is an enlarged vertical front cross-sectional view of the essential portion of the paper dispensing device.

The roller member 10 is formed by a wheel 10*a* and a ring member 10*b*, an annular groove is formed on the circumferential side surface of the wheel 10*a*, and the ring member 10*b* is fitted in the groove (see FIG. 3D). A rubber material is preferably used as the material of the ring member 10*b*. The axially supporting portions 11*a* of the bearing member 11 are formed in such a manner as to project from the advancing-direction side of the bearing member 11 (see FIGS. 2A to 2C).

In addition, a pawl member 14 is fitted to the bearing member 11. The pawl member 14 is formed of a thin metal plate, and is secured to a pawl-member fixing slit 11*b* by press fitting or by a fastening means such as an adhesive agent. Thus, the pawl member 14 is arranged as a substantially cantilevered type, and is structured such that its deflection occurs only in one direction. A distal end of the pawl member 14 is engaged with the teeth 13*a* of the ratchet wheel 13 (see FIGS. 3A to 3C).

Specifically, the pawl-member fixing slit 11*b* of the bearing member 11 is used to support and secure the pawl member 14 in the horizontal direction. The pawl-member fixing slit 11*b* is arranged such that the portion of the bearing member 11 which is located on the upper side of the pawl-member fixing slit 11*b* projects from the advancing-direction side of the bearing member 11. Thus, a free end portion of the pawl member 14 has a wide surface of contact with the aforementioned projecting portion of the bearing member 11 located on the upper side of the pawl-member fixing slit 11*b*, thereby allowing the free end portion of the pawl member 14 to be reflected only in the downward direction (see FIG. 3C).

Then, when the tooth 13*a* of the ratchet wheel 13 acts to push up the pawl member 14, the ratchet wheel 13 becomes nonrotatable, and the roller member 10 also becomes nonrotatable in conjunction with the same.

On the other hand, when the tooth 13*a* of the ratchet wheel 13 acts to push down the pawl member 14, the pawl member 14 is deflected downward by a large amount, so that the ratchet wheel 13 is able to rotate easily, with the result that the roller member 10 also rotates.

Each of the teeth 13*a* of the ratchet wheel 13 has an inclined tooth face $\mathbf{13}a_1$ which is inclined substantially along the circumferential direction as well as a vertical tooth face $\mathbf{13}a_2$ which extends in the radial direction. When the ratchet wheel 13 rotates, the inclined tooth face $\mathbf{13}a_1$ abuts against the pawl member 14 and is able to easily deflect and deform the pawl member 14 (see FIG. 3C).

Meanwhile, when the ratchet wheel 13 becomes nonrotatable, the vertical face $\mathbf{13}a_2$ abuts against the pawl member 14, in which case the resistance which the tooth 13*a* receives from the pawl member 14 becomes large, so that the ratchet wheel 13 becomes unable to rotate (see FIG. 3B).

In the above-described structure, in the reciprocating motion of the bearing member 11 and the roller member 10, the roller member 10 is made nonrotatable in the advancing direction, and is made rotatable in the returning direction.

Here, the advancing direction in the reciprocating motion of the roller member 10 and the bearing member 11 refers to the direction in which action takes place so as to cause the uppermost piece of paper p of the stack of paper P to be lifted up. With reference to FIG. 2A, this advancing direction refers to the direction in which the roller member 10 and the bearing member 11 move from the left-hand side toward the right-hand side. On the other hand, the returning direction (see, e.g., FIG. 3C) refers to the direction in which the roller member 10 and the bearing member 11 conversely move from the right-hand side toward the left-hand side.

As a modification of the first example of the paper dispensing device C, the pair of axially supporting portions 11*a* of the bearing member 11 may be formed in such a manner as to project on the returning-direction side of the bearing member 11, and the roller member 10 and the ratchet wheel 13 are provided on the returning-direction side of the bearing member 11.

Figure 4A:
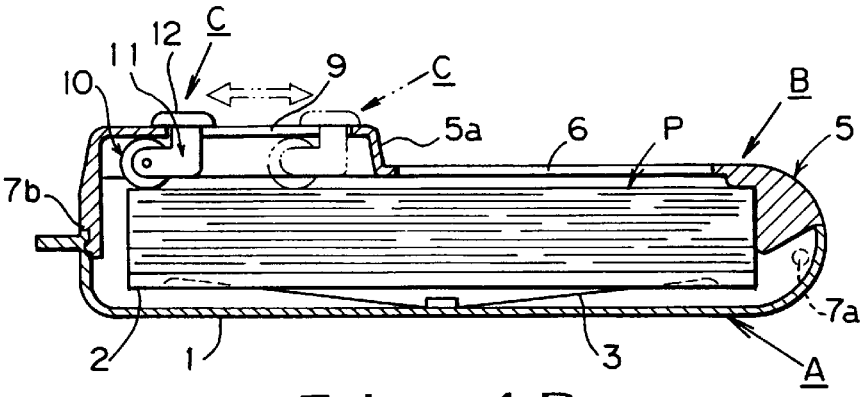
FIG. 4A is a longitudinal cross-sectional view of a modification of the first example of the paper dispensing device.
Figure 4B:
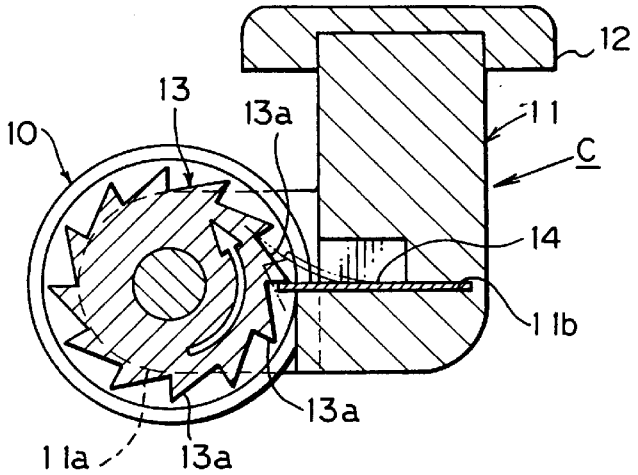
FIG. 4B is an enlarged vertical cross-sectional view of an essential portion of the modification of the first example of the paper dispensing device shown in FIG. 4A.

In this modification, the deflecting direction of the pawl member 14 is opposite to that of the above-described example, i.e., the pawl member 14 is made deflectable in the upward direction and nondeflectable in the downward direction, and the ratchet wheel 13 and the roller member 10 are nonrotatable in the advancing direction and rotatable in the returning direction (see FIGS. 4A and 4B).

Figure 4C:
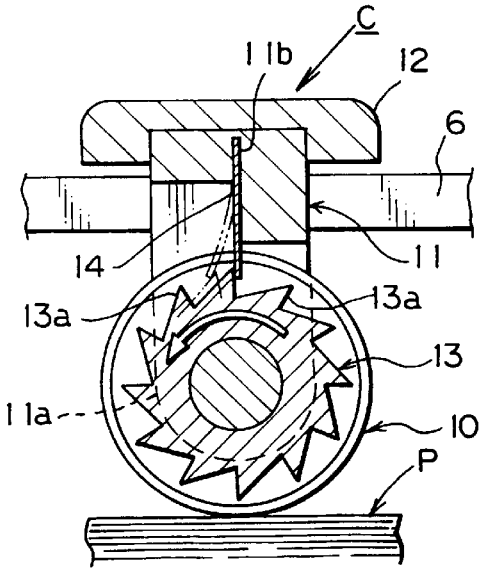
FIG. 4C is an enlarged vertical cross-sectional view of an essential portion of another modification of the first example of the paper dispensing device.

As another modification of the first example of the paper dispensing device C, an arrangement may be provided such that the pair of axially supporting portions 11*a* of the bearing member 11 are formed in the vertical direction, and the pawl member 14 is fitted vertically to the bearing member 11. In this modification, the pawl member 14 is made deflectable in the returning direction and nondeflectable in the advancing direction, and the ratchet wheel 13 and the roller member 10 are nonrotatable in the advancing direction and rotatable in the returning direction in the same way as described above (see FIG. 4C).

Figure 5A:
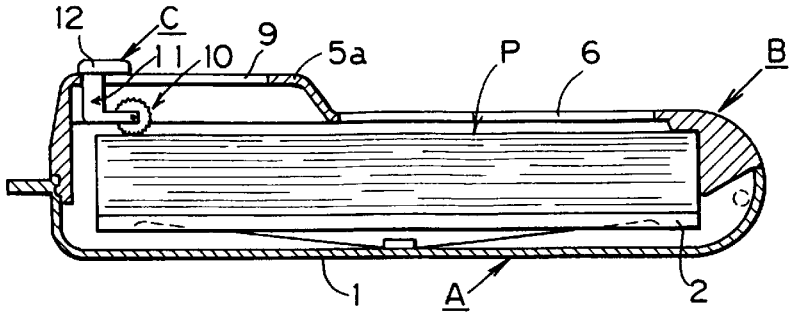
FIG. 5A is a longitudinal cross-sectional view of a second example of the paper dispensing device.
Figure 5B:
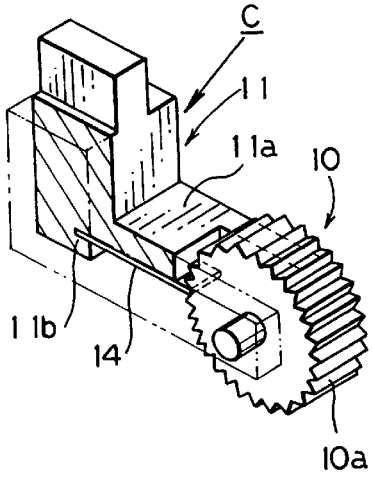
FIG. 5B is an enlarged perspective view, partly in section, of an essential portion of the second example of the paper dispensing device shown in FIG. 5A.
Figure 5C:
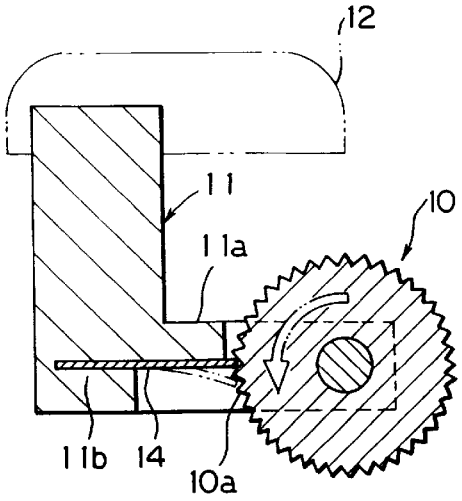
FIG. 5C is an enlarged vertical cross-sectional view of the essential portion of the second example of the paper dispensing device.

As shown in FIGS. 5A to 5C, in a second example of the paper dispensing device C, the ratchet wheel 13 used in the above-described first example of the dispensing device C is not used, and the dispensing device C is comprised of the pawl member 14 and the roller member 10 in addition to the bearing member 11 and the thumb slider 12. The roller member 10 is constituted by a toothed wheel 10*a*, and the pawl member 14 is structured so as to be engageable with the teeth of the wheel 10*a*.

Action which is substantially similar to the one performed between the ratchet wheel 13 and the pawl member 14 in accordance with the above-described first example of the paper dispensing device C is performed between the roller member 10 and the pawl member 14 in this second example of the paper dispensing device C.

The wheel 10*a* constituting the roller member 10 is preferably formed in the shape of a toothed wheel having a multiplicity of small teeth. In addition, the toothed wheel 10*a* also serves to cause appropriate friction with respect to the piece of paper p when pushing out the uppermost piece of paper p of the stack of paper P. As a result, the roller member 10 and the piece of paper p are set in a favorable state of abutment with each other, so that it is possible to effect the operation of dispensing the piece of paper p effectively in a more simple arrangement.

In this second example of the paper dispensing device C as well, there are three types in the same way as the first example: a first type in which the roller member 10 is provided on the advancing-direction side of the bearing member 11, a second type in which the roller member 10 is provided on the returning-direction side of the bearing member 11, and a third type in which the roller member 10 is provided in the vertical direction of the bearing member 11.

Referring now to FIGS. 7A and 7B, FIG. 8, and FIGS. 9A to 9C, FIGS. 10A and 10B, a description will be given of a second embodiment of the present invention. In this second embodiment, a stacked-paper pressing rod 16, together with the paper dispensing device C, is fitted inside the protruded portion 5*a* of the above-described cover B. This embodiment is applied in a case where the protruded portion 5*a* is formed over the entire widthwise range of the cover B (see FIG. 7A). More specifically, this embodiment is applicable in a case where the widthwise dimension of the protruded portion 5*a* is larger than the widthwise dimension of the stack of paper P.

Namely, the arrangement provided in this second embodiment is designed to prevent a situation in which when an attempt is made to push out the piece of paper p by means of the paper dispensing device C, the piece of paper p is lifted up excessively inside the protruded portion 5*a*, causing the piece of paper p to be jammed inside the protruded portion 5*a*.

Figure 8:
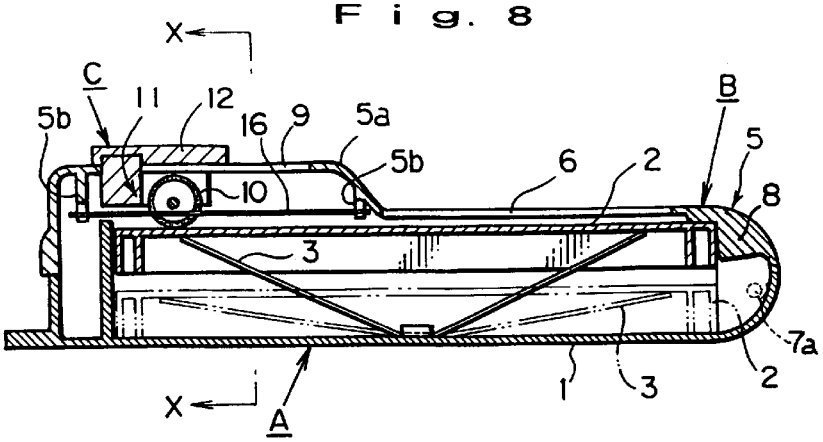
FIG. 8 is a longitudinal cross-sectional view of the stacked-paper dispenser in which the stacked-paper pressing rod of the first type is provided.

The stacked-paper pressing rod 16 is provided substantially in such a manner as to extend in the longitudinal direction in the center of the interior of the protruded portion 5*a*, and is located in close proximity to the obverse surface side of the stacked-paper placing base 2 (see FIG. 8). When the stack of paper P is placed on the stacked-paper placing base 2, the stacked-paper pressing rod 16 comes into close proximity to the uppermost piece of paper p, holds down the piece of paper p which tends to be lifted up, thereby making it possible to prevent the piece of paper p from becoming jammed inside the protruded portion 5*a* (see FIG. 8).

Figure 9A:
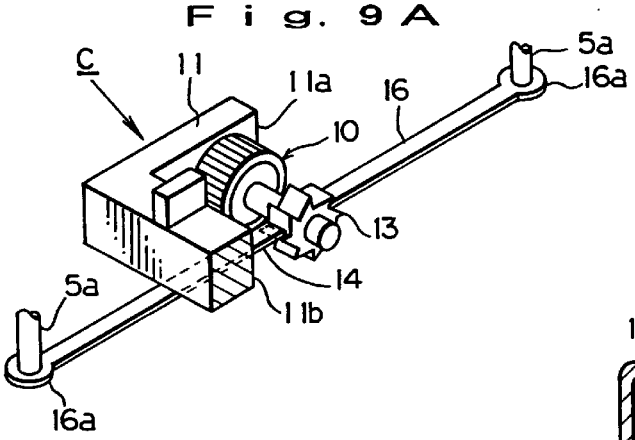
FIG. 9A is a perspective view illustrating a state in which the paper dispensing device and the stacked-paper pressing rod of the first type are combined.
Figure 9B:
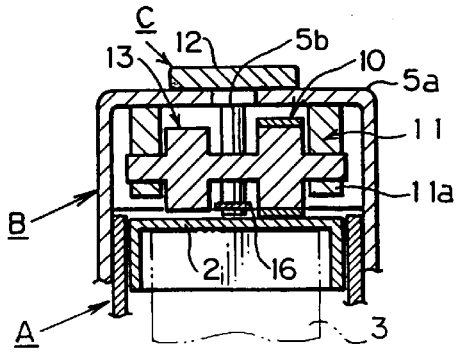
FIG. 9B is a cross-sectional view taken in the direction of arrows along line X—X of FIG. 8.
Figure 9C:
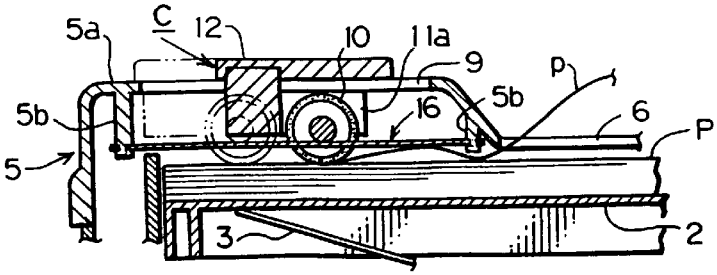
FIG. 9C is a diagram illustrating a state in which the lifting up of the piece of paper inside the protruded portion is prevented by the stacked-paper pressing rod of the first type.
Figure 10A:
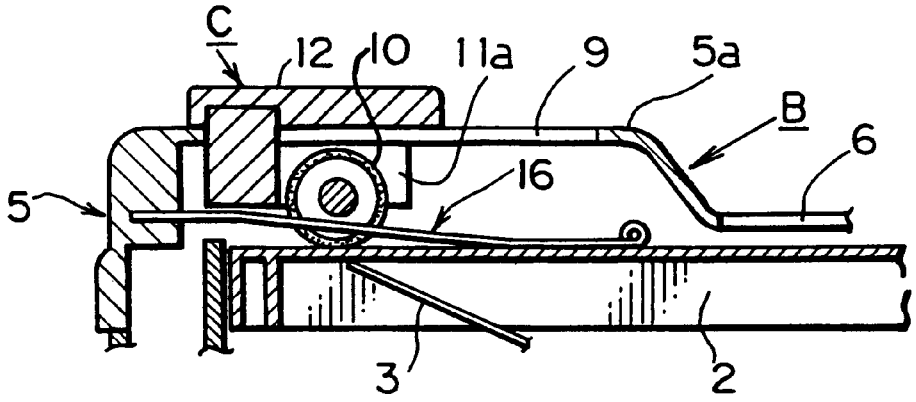
FIG. 10A is a longitudinal cross-sectional view of the stacked-paper dispenser in which the stacked-paper pressing rod of a second type is provided.
Figure 10B:
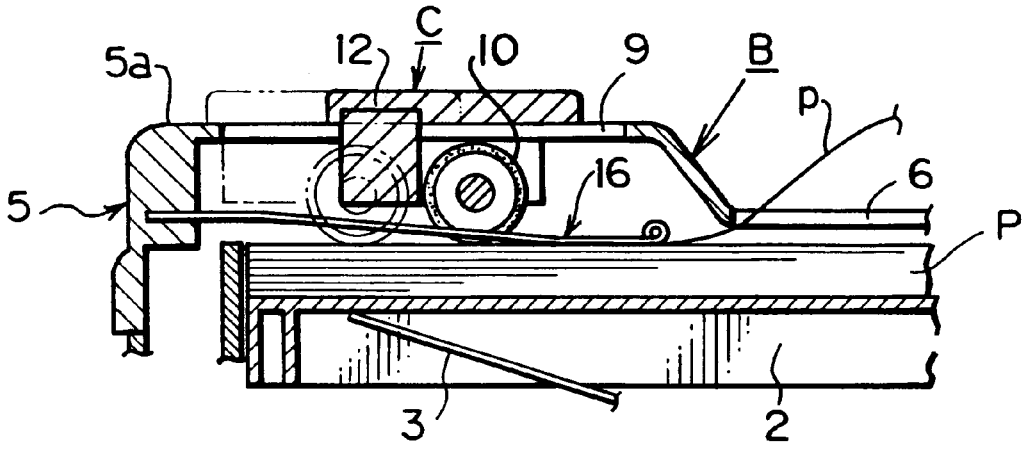
FIG. 10B is a diagram illustrating a state in which the lifting up of the piece of paper inside the protruded portion is prevented by the stacked-paper pressing rod of the second type.

Further, the structure provided is such that the stacked-paper pressing rod 16 is located between the roller member 10 and the ratchet wheel 13 of the paper dispensing device C, so that the roller member 10 and the ratchet wheel 13 do not come into contact with the stacked-paper pressing rod 16 during the reciprocating movement of the paper dispensing device C (see FIGS. 9A and 9B).

Figure 7B:
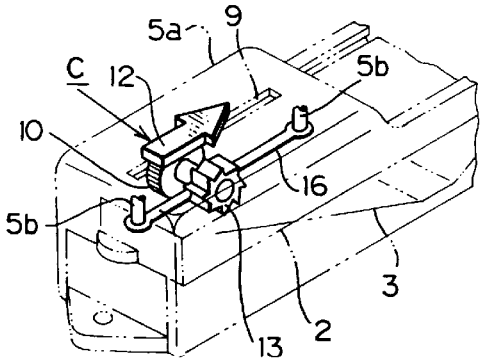
FIG. 7B is a perspective view of the stacked-paper dispenser in accordance with the second embodiment of the present invention, and illustrates the structure of a stacked-paper pressing rod of a first type and the paper dispensing device.

As a first type of the stacked-paper pressing rod 16, the stacked-paper pressing rod 16 is arranged such that a pair of attaching and fixing portions 16*a* are formed at its longitudinal opposite ends, and are respectively fixed to a pair of projections 5*b* which are formed at longitudinal opposite side portions in the interior of the protruded portion 5*a*, thereby fixing the stacked-paper pressing rod 16 inside the protruded portion 5*a* (see FIGS. 7B and 8). The stacked-paper pressing rod 16 is formed of a metal or synthetic resin or the like.

Next, in a second type of the stacked-paper pressing rod 16, one longitudinal end of the stacked-paper pressing rod 16 is fixed, and the other end thereof is set free. The fixed portion of the stacked-paper pressing rod 16 is fixed to an inner surface of the protruded portion 5*a*. Specifically, an enlarged-thickness portion is formed on the inner surface, and the stacked-paper pressing rod 16 is fixed to the enlarged-thickness portion in an inserted state (see FIG. 1A). The free side at the other longitudinal end of the stacked-paper pressing rod 16 constantly presses the uppermost piece of paper p of the stack of paper P resiliently with appropriate pressure, thereby making it possible to prevent the lifting up of the piece of paper p inside the protruded portion 5*a* (see FIG. 10B).

Figure 6:
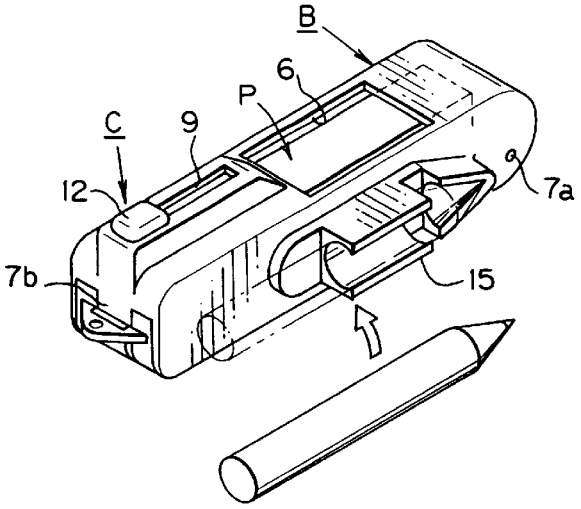
FIG. 6 is a perspective view of the stacked-paper dispenser having a penholder provided on the cover.

In addition, with the stacked-paper dispenser in accordance with the present invention, the remaining volume of the stack of paper P can be confirmed if the accommodating member A and the cover B are formed of a material such as a transparent plastic, or if a confirming window is formed in parts of the accommodating member A and the cover B, although such arrangements are not shown. Further, as shown in FIG. 6, a penholder 15 may be formed on the cover B so as to fit a pen thereto.

In operation, the cover B is first opened, the stack of paper P is placed on the stacked-paper placing base 2, and the cover B is closed. At this time, the stack of paper P is accommodated in such a manner that the adhesive side thereof is located on the side of the pivotally supporting portions 7*a* of the accommodating member A and the cover B. Then, after the cover B is closed, the stack of paper P on the stacked-paper placing base 2 is pressed toward the bottom of the accommodating member A, the resilient member 3 is contracted, and a restoring force is produced in the resilient member 3, thereby allowing the stack of paper P to be constantly pressed toward the cover B. In addition, the holding portion 8 formed in the cover B is adapted to press the adhesive side of the stack of paper P.

The paper dispensing device C reciprocates along the guide hole 9 formed in the cover B, and the initial position of the thumb slider 12 is set as a starting point in the advancing direction (see FIG. 1C). Then, if the thumb slider 12 is moved toward a terminating point in the advancing direction, the roller member 10 moves in a nonrotatable state, so that friction is caused on the abutting surfaces of the roller member 10 and the piece of paper p. As a result, the piece of paper p is lifted up from the remaining stack of paper P, and the lifted-up portion projects from the opening portion 6 in the cover B, thereby making it possible to take out the piece of paper p (see FIGS. 2A and 2B).

Further, when the paper dispensing device C is moved in the returning direction so as to be returned to its original position, the roller member 10 is rotatable in the returning direction. Since the roller member 10 rotates when moving on the upper surface of the stack of paper P in the returning direction, the friction between the roller member 10 and the uppermost piece of paper p of the stack of paper P is very small, so that the roller member 10 does not drag the uppermost piece of paper p with respect to the stack of paper P (see FIG. 2C).

What is claimed is:

1. A stacked-paper dispenser for dispensing a piece of paper from a stack of paper, comprising:

an accommodating member for receiving the stack of paper therein;

a stacked-paper placing base on which the stack of paper is adapted to be placed, said stacked-paper placing base being fitted in said accommodating member and adapted to be resiliently raised upward;

a cover having an opening for dispensing the piece of paper; and a paper dispensing device including a bearing capable of reciprocating in a longitudinal direction on an inner surface side of said cover, a roller supported by said bearing so as to be nonrotatable in an advancing direction of said bearing and rotatable in a returning direction, and a thumb slider operated from outside said cover for moving said bearing in said advancing and returning directions to thereby initially cause a center portion of an uppermost sheet of paper to protrude upwardly from said cover through said opening.

2. The stacked-paper dispenser according to claim 1, wherein an outer periphery of said roller has a multiplicity of small projections.

3. A stacked-paper dispenser in which a stack of paper is accommodated for dispensing a piece of paper, comprising:

an accommodating member for accommodating the stack of paper therein;

a stacked-paper placing base on which the stack of paper is placed, said stacked paper placing base being fitted in said accommodating member and adapted to be resiliently raised upward;

a cover having an opening portion for dispensing the piece of paper, said cover having a protruded portion which is located adjacent to the opening portion and is formed over an entire widthwise range of said cover so as to protrude upwardly; and a paper dispensing device including a bearing member capable of reciprocating in a longitudinal direction on an inner surface side of said protruded portion, a roller member which is axially supported by said bearing member and which is nonrotatable in the movement in an advancing direction of said bearing member and rotatable in a returning direction, a stacked-paper pressing rod provided in a reciprocating range of said roller member and in proximity to a side of said roller member which is closer to said stacked-paper placing base, and a thumb slider for operating said bearing member from outside said cover.

4. The stacked-paper dispenser according to claim 3, wherein said stacked-paper pressing rod has its longitudinal opposite ends fixed to longitudinal opposite side portions in an interior of said protruded portion.

5. The stacked-paper dispenser according to claim 3, wherein said stacked-paper pressing rod has one longitudinal end fixed to a longitudinal rear end portion of an inner surface of said protruded portion, and another longitudinal end set free, such that said stacked-paper pressing rod is constantly set in a state of resiliently pressing the stack of paper toward said stacked-paper placing base.

6. A stacked-paper dispenser for dispensing a piece of paper from a stack of paper, comprising:

an accommodating member for receiving the stack of paper therein;

a stacked-paper placing base on which the stack of paper is adapted to be placed, said stacked-paper placing base being fitted in said accommodating member and adapted to be resiliently raised upward;

a cover having an opening for dispensing the piece of paper; and a paper dispensing device including a bearing capable of reciprocating in a longitudinal direction on an inner surface side of said cover, a roller supported by said bearing so as to be nonrotatable in an advancing direction of said bearing and rotatable in a returning direction, and a thumb slider operated from outside said cover for moving said bearing in said advancing and returning directions, wherein said thumb slider is located in longitudinally spaced adjacent relationship to one end of said opening.

7. A stacked-paper dispenser for dispensing a piece of paper from a stack of paper, comprising:

an accommodating member for receiving the stack of paper therein;

a stacked-paper placing base on which the stack of paper is adapted to be placed, said stacked-paper placing base being fitted in said accommodating member and adapted to be resiliently raised upward;

a cover having an opening for dispensing the piece of paper; and a paper dispensing device including a bearing capable of reciprocating in a longitudinal direction on an inner surface side of said cover, a roller supported by said bearing so as to be nonrotatable in an advancing direction of said bearing and rotatable in a returning direction, and a thumb slider operated from outside said cover for moving said bearing in said advancing and returning directions, said opening extending parallel to said stacked-paper placing base.

8. A stacked-paper dispenser for dispensing a piece of paper from a stack of paper, comprising:

an accommodating member for receiving the stack of paper therein;

a stacked-paper placing base on which the stack of paper is adapted to be placed, said stacked-paper placing base being fitted in said accommodating member and adapted to be resiliently raised upward;

a cover having an opening for dispensing the piece of paper; and a paper dispensing device including a bearing capable of reciprocating in a longitudinal direction on an inner surface side of said cover, a roller supported by said bearing so as to be nonrotatable in one direction of said bearing and rotatable in another direction, and a thumb slider operated from outside said cover for moving said bearing in said advancing and returning directions to thereby initially cause a center portion of an uppermost sheet of paper to protrude upwardly from said cover through said opening.

* * * * *